US010182961B2

(12) United States Patent
Whittier

(10) Patent No.: US 10,182,961 B2
(45) Date of Patent: Jan. 22, 2019

(54) AROMATHERAPY MASSAGE SPHERES

(76) Inventor: Stephanie Whittier, New York, NY (US)

( * ) Notice: Subject to any disclaimer, the term of this patent is extended or adjusted under 35 U.S.C. 154(b) by 244 days.

(21) Appl. No.: 10/937,939

(22) Filed: Sep. 11, 2004

(65) Prior Publication Data

US 2005/0283100 A1 Dec. 22, 2005

(51) Int. Cl.
*A61H 15/00* (2006.01)

(52) U.S. Cl.
CPC ..... *A61H 15/00* (2013.01); *A61H 2015/0064* (2013.01); *A61H 2201/102* (2013.01); *A61H 2201/105* (2013.01); *A61H 2201/1284* (2013.01)

(58) Field of Classification Search
CPC ..... A61H 15/00; A61H 2201/102; A61H 2201/105; A61H 2015/0064; A61H 2201/1284
USPC ..... 601/131, 17, 18, 19, 122, 123, 124, 125, 601/128, 129, 132, 135, 137, 138; 239/34, 60
See application file for complete search history.

(56) References Cited

U.S. PATENT DOCUMENTS 1,780,479 A * 11/1930 Griffith ..... 601/131
2,215,988 A * 9/1940 Vivaudou et al. ..... 239/55
2,466,470 A * 4/1949 Norris ..... 601/131
4,191,178 A * 3/1980 Wisnieski ..... 601/131
5,520,617 A * 5/1996 Wei ..... 601/134
5,779,652 A * 7/1998 Mencher-Aliazzo ..... 601/132
6,007,501 A * 12/1999 Cabados et al. ..... 601/15
6,695,800 B1 * 2/2004 Gary et al. ..... 601/154
6,883,994 B1 * 4/2005 Grogg ..... 401/201
7,137,570 B2 * 11/2006 Wheatley et al. ..... 239/32
7,156,817 B1 * 1/2007 Cassidy Phillips ..... A61H 15/0092 601/131
7,214,205 B2 * 5/2007 Sils ..... A61H 7/001 601/131
7,458,945 B2 * 12/2008 Zemont ..... 601/131
2003/0144616 A1 * 7/2003 Henderson ..... 601/131
2004/0241186 A1 * 12/2004 Huang ..... 424/745
2005/0033205 A1 * 2/2005 Komkin et al. ..... 601/131
2005/0159688 A1 * 7/2005 Sakamoto et al. ..... 601/123

FOREIGN PATENT DOCUMENTS

JP 405317398 A * 12/1993 ..... A61L 9/01

OTHER PUBLICATIONS

International Fitness Promotions Pty Ltd (IFP), *The ChiBall Method for harmony, balance and wellbeing*, http://www.chiball.com/about/, 2005.

* cited by examiner

*Primary Examiner* — Quang D Thanh
(74) *Attorney, Agent, or Firm* — Dara L. Onofrio, Esq.; Onofrio Law

(57) ABSTRACT

A massage device including at least one spherical ball permeated with aromatherapy is provided. A method of making and using the massage device, as well as a kit for making the massage device are also provided.

14 Claims, 4 Drawing Sheets

AROMATHERAPY MASSAGE SPHERES

RELATED APPLICATIONS

This application claims the benefit of U.S. Provisional Patent Application No. 60/503,164, which is incorporated herein by reference in its entirety.

BACKGROUND OF INVENTION

This invention generally relates to the fields of massage therapy and aromatherapy in combination, and to aromatherapy massage methods, devices and kits useful for topical manipulation and olfactory stimulation to relieve the mind and body of a user from stress.

Massage therapy and aromatherapy are each recognized as important, effective and commonly used alternative modalities for stress reduction in the world today.

For example, recently researchers at the Royal Berkshire Hospital NHS Trust, Reading, United Kingdom, studied the effects of aromatherapy in an intensive care unit as a means of helping to alleviate anxiety and stress. The results revealed a demonstrable improvement in the aromatherapy group. See Journal of Advanced Nursing (England) January 1995, 21 (1) p. 34-40.

In 1991-92 at the Middle Sex Hospital, in the intensive care unit, a study was conducted to evaluate the effects of aromatherapy foot massage on patients one day after cardiac surgery. In the study, it was found that there were significant short-term psychological results in the two massage groups demonstrating more improvement than two control groups. Initially, no significant difference was seen between the plain oil control groups and the aromatherapy groups (neroli). But these results changed when long-term differences were evaluated. On day five, patients' perception of the effects of the massage were very positive. The aromatherapy groups found the effects more relaxing, calming and restful than the control group. The aromatherapy group also found the positive effects to last longer than the other groups.

In another study, reviewed by Carol Howdyshell, published in the Hospice Journal in 1998-Wendy Maddocks (1994) replaced a daily dosage of Temazepam, a sleeping aid, with a session of aromatherapy inhalation using lavender and geranium. This was found to be effective in promoting sleep, replacing the use of the pharmaceutical.

Stated by Wayne Jonas MD and Jeffrey Levin PH.D, M.P.H. in "Essentials of Complimentary and Alternative Medicine" (1999) "Most diseases are exacerbated by stress. And given that massage therapy alleviates stress, receiving massage should probably be ranked with diet and exercise on any list of health priorities, as it was in India around 1800 B.C."

Massage therapy reduces stress, improves sleep and mood and reduces pain. Massage therapy recipients normally show immediate effects including improved mood state and decreased anxiety and stress hormone levels. Longer-term changes (after 4-6 weeks of treatment) include decrease in depression, improved sleep patterns, lower stress and enhanced immune function, Marilyn Maiser, University of Minnesota.

Recent research by Dr. G. Schwartz, professor of psychology and Psychiatry at Yale University, revealed that certain aromas can even lower blood pressure. Interestingly, the body's sense of smell is over 10,000 times more sensitive than the sense of taste and researchers have shown that aromas cause a brain reaction, activating the hypothalamus gland, the pituitary gland, and the body's hormones as well as stimulating the limbic system (center for emotion and memory) in the brain. The work carried out by Dr. Schwartz found that the calming and relaxing effects of aromatherapy essential oils and massage in combination can help relieve accumulated tensions and stress.

There have been many massage therapy devices developed in the past, but none have included the infusion of aromatherapy into the device. The use of aromatherapy in heat packs, eye pillows and other household self-care items has been described but none of these are massage devices.

One example of a non-hand held massage therapy device is U.S. Patent Publication No. 20030144616 to James A. Henderson. This device shows the use of two rubber spheres 2" in diameter encompassed in a nylon sac 12" in length. This device is limited to the scope of range the spheres can massage, the size of the spheres and does not incorporate aromatherapy. By not encompassing the spheres in a limited length sac the user is allowed to cover a broader area and use the spheres more freely. Non-confined spheres can be utilized with a larger range of motion effect and placed in any spot the user desires. The user can more easily simulate a massage session with the free rolling spheres. In an advanced user massage session the user can add more (3-4) spheres, thus massaging the full length of a muscle or fascial sheath. The infusion of aromatherapy into the spheres deepens the stress relief function of the massage device as mentioned in the above background.

Another example of a non-hand held massage device is U.S. Patent No. 20040006294 to Cheryl E. Zemont. This device is a spherical ball with added nodules that project axially from the surface of the ball. This prevents the user from rolling upon the device in a smooth relaxing manner. This device is specifically for trigger points in muscles and also does not incorporate aromatherapy. This device is used for specific areas in muscles to bring fresh blood and oxygen to a specific point. In addition, the nodes on the sphere of this device prevent the user from massaging the length of a muscle in a smooth relaxing manner or from working with fascial tissue (the connective tissue of the body that runs in large sheaths and holds tensions and memory of trauma).

Thus, there is a need for a massage device that combines both aromatherapy and massage in a single device, whose use delivers both massage and aromatherapy.

Prior to this invention, there has not been a massage device specifically designed to combine aromatherapy and massage in one device. Therefore, there is a need for a device that includes aromatherapy into the massage allowing optimum mind and body relaxation.

SUMMARY OF INVENTION

The present invention generally relates to a device, method and kit for delivery of stress and tension reducing massage therapy and aromatherapy inhalation. More particularly, the invention relates to a spherical smooth surface massage ball saturated with aromatherapy that is useful for treating stress related anxieties and accomplishing the psychotherapeutic qualities of an aromatherapy massage, and to methods of making and using the same.

In accordance with one aspect of the present invention, the invention includes a massage device including at least one spherical ball, in which the ball is permeated with aromatherapy.

Also included are variations of the massage device in which the spherical balls are constructed using at least one compound selected from the group including silicon, rubber and organic rubber compound.

Additionally, another aspect of the invention includes the massage device described above, in which the aromatherapy comprises an essential oil which emits qualitative elements for medicinal purposes.

In another aspect of the invention the spherical ball or balls are configured for rotational manipulation around a user's body. In an aspect, the balls are configured for placement between the user's body and a flat surface, and wherein the rotational manipulation of the ball is self-directed by the user.

In another aspect of the invention, the balls are rotationally manipulated around a user's body by another person.

In another aspect of the invention, the balls are configured to release aromatherapy vapors during manipulation.

Additionally, in another aspect of the invention, the balls may have a diameter of between one quarter of an inch and six inches.

In another aspect of the invention, two or more balls of equal size are used.

In another aspect of the invention, two or more balls of varying size are used.

In accordance with another aspect of the invention, a method of making a massage device is described. The method includes the step of introducing a liquid aromatherapy to the surface of one or more spherical massage balls.

In one aspect of the invention, the method of making a massage device includes spraying the massage balls with liquid aromatherapy.

Additionally, another aspect of the invention includes a method of making a massage device including the steps of placing aromatherapy into a reservoir portion of a container and immersing one or more spherical massage balls in the reservoir portion of the container for a period of time sufficient for the aromatherapy to saturate the one or more spherical massage balls.

In an aspect of the invention, in the method described above, the aromatherapy comprises an essential oil which emits qualitative elements for medicinal purposes.

Another aspect of the invention includes placing the one or more spherical massage balls into a bag having a sleeve portion into which the one or more spherical massage balls fits, and securing the balls within the bag so that the bag containing the balls is usable as an integrated massage device.

In another aspect of the invention, the bag may be plastic or cloth.

Another aspect of the invention includes a method of aromatherapy massage for a user including the placing one or more spherical massage balls saturated with aromatherapy between the user and a surface and causing the user to move relative to the surface so that the one or more spherical massage balls rotates while maintaining contact with the user and the surface.

Another aspect of the invention includes an aromatherapy massage kit, including one or more spherical massage balls, one or more aromatherapy essential oils, and a container for immersing the one or more spherical massage balls into one of the aromatherapy essential oils.

It is understood that both the foregoing general description and the following detailed description are exemplary and are intended to provide further explanation of the invention claimed.

BRIEF DESCRIPTION OF THE DRAWINGS

The accompanying drawings, which are incorporated in and constitute part of this specification, are included to illustrate and provide a further understanding of the device, methods, and kit of the invention. Together with the description, the drawings serve to explain the principles of the invention.

FIG. 1(*b*) depicts a spherical massage ball after introduction of aromatherapy in accordance with an embodiment of the present invention;

DESCRIPTION OF THE PREFERRED EMBODIMENTS

The present invention advantageously provides a massage device that delivers aromatherapy during its use in a massage.

It also advantageously relieves a user from the need to carry both a massage device and an aromatherapy delivery system, as well as relieving the user of the necessary expenditure for such a separate aromatherapy delivery system or its use.

Additionally, the present invention includes a method for making a massage device that delivers aromatherapy during its use.

The present invention also advantageously provides a method of aromatherapy massage that allows a user to receive aromatherapy massage using only the massage device.

The present invention also advantageously provides a kit for a user to prepare an aromatherapy massage device.

Use of the singular and plural forms in references to the spherical massage balls or devices herein are not intended to be limiting. Thus, where a single massage ball is referred to, it is understood that use of more than one massage ball is also contemplated.

"Aromatherapy" as used herein means any aromatherapy substance, including, without limitation, any liquid having aromatherapy essential oil, such as Neroli, Citrus aurantium, or any other substance capable of emitting qualitative elements for medicinal purposes. Such aromatherapy is usually in a liquid form, although a variation in the present invention using a vapor phase aromatherapy is also envisioned. Aromatherapy is also a therapeutic technique that utilizes pure aromatic essential oils drawn from flowers, plants and herbs to induce relaxation of the central nervous system via the olfactory senses and reduce stress. It will be apparent from the context whether the technique or the substance is being referred to. For example, when aromatherapy is being applied to the spherical massage balls, the substance is being referred to.

Use of the terms "permeation" or "infusion" herein generally refer, without limitation, to the soaking or impregnation of aromatherapy onto and into spherical massage balls so that the balls retain a sufficient quantity of aromatherapy so as to emit useful quantities of qualitative elements for medicinal purposes.

Massage therapy is a therapeutic practice of kneading, stroking or pressing upon the muscles and connective tissues of the body to bring about optimum health.

The present invention relates to a device and method for stress reduction through combined aromatherapy/essential oil and massage therapy utilizing a massage device that is a spherical ball infused with aromatherapy/essential oil.

Figure 1A:
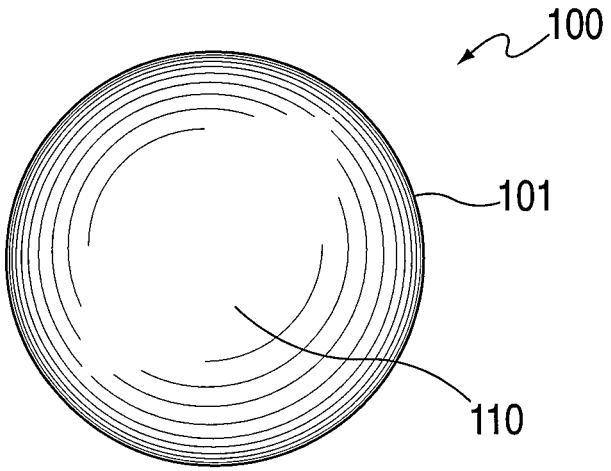
FIG. 1(*a*) depicts a spherical massage ball prior to introduction of aromatherapy in accordance with an embodiment of the present invention.
Figure 1B:
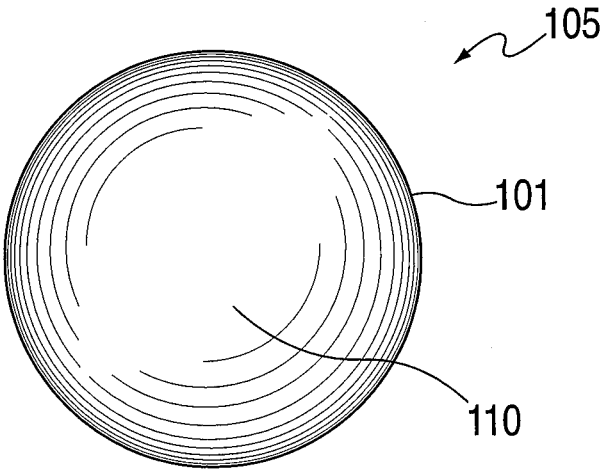

FIG. 1(*a*) depicts a spherical massage ball 100 prior to introduction of aromatherapy in accordance with an embodiment of the present invention. The massage ball 100 includes a surface 101 and an interior portion 110. The surface 101 of the massage ball is preferably smooth so as to facilitate rotational use in massage. In a preferred embodiment the surface 101 is also porous to allow the introduction of aromatherapy liquid (also referred to herein as "aromatherapy").

In another embodiment, the surface 101 of the massage ball 100 is textured. For example, raised protrusions (not depicted) on the massage ball 100 would allow for delivery of variations of effective massage techniques, such as massage of trigger points, as well as other techniques.

The massage balls of an embodiment of the present invention are preferably constructed of at least one compound selected from the group consisting of silicon, rubber and an organic rubber compound. Alternatively, any compound having the elastic and absorption qualities of these materials may be used, as one of skill in the art readily knows. The massage balls may be constructed by mold injection or any other known casting technique.

FIG. 1(*b*) depicts a spherical massage ball after introduction of aromatherapy 105. In a preferred embodiment the aromatherapy 105 has permeated at least some depth into the interior portion 110 of the massage ball.

Figure 2:
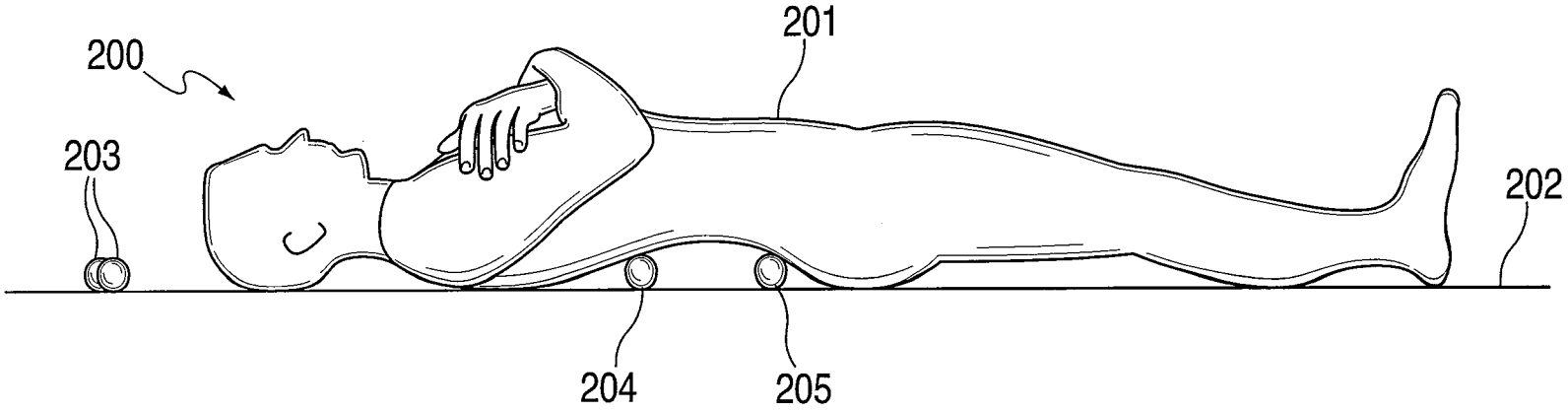
FIG. 2 depicts an exemplary use of aromatherapy massage spheres in accordance with an embodiment of the invention.

FIG. 2 is a diagram depicting an exemplary use of aromatherapy massage spheres in accordance with an embodiment of the invention. In an embodiment, a user 201 can lie on his back with the aromatherapy massage balls 203 placed between himself and a flat surface. Line 202 is used in this diagram to represent both a cross section of the flat surface and a diagrammatic representation of the user's spine, to indicate some preferred placement of the aromatherapy massage balls in an embodiment. For example, aromatherapy massage balls 203 may be placed in tandem on either side of the user's spine, thereby delivering a particularly useful form of massage. Other aromatherapy massage ball placements may include the upper 204, mid (not depicted), and lower 205 back. Aromatherapy is preferably delivered during the massage by diffusion and evaporation of the aromatherapy liquid 105 from the interior portion 110 and the surface 101 of the aromatherapy massage balls. This delivery of aromatherapy is preferably assisted by the user's body heat and by the rotational motion of the aromatherapy massage balls, and their deformation during the massage.

Figure 3:
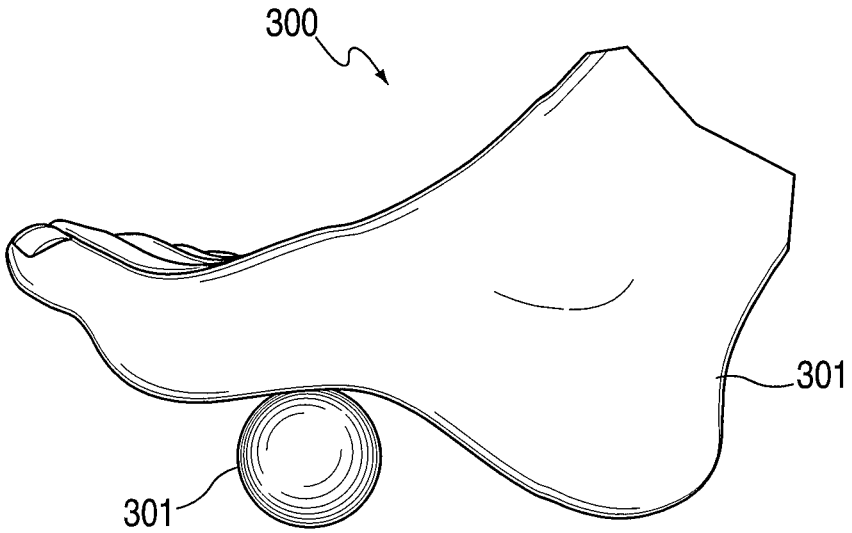
FIG. 3 depicts an exemplary use of aromatherapy massage spheres in accordance with an embodiment of the invention.

Another exemplary use of the aromatherapy massage balls is depicted in FIG. 3. A user's foot 301 may apply pressure to an aromatherapy massage ball at the bottom of the user's foot 301.

Figure 4:
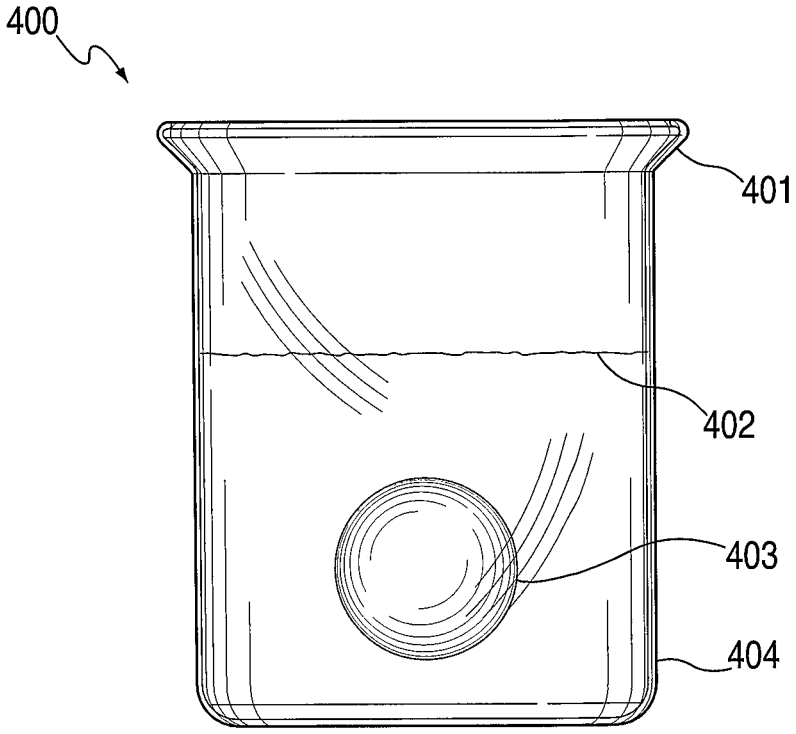
FIG. 4 depicts an exemplary process of soaking the spheres in aromatherapy in an airtight container in accordance with an embodiment of the present invention.

FIG. 4 is a schematic diagram illustrating the process of making a massage device in accordance with an embodiment of the invention. A massage ball 403 is immersed in a volume of liquid aromatherapy 402 placed in a container 404 preferably having a lid 401. The massage ball 403 is allowed to absorb the liquid aromatherapy 402 until it achieves a desired degree of permeation or infusion. Use of the lid 401 to seal the container 404 is preferred to prevent the evaporative loss of the liquid aromatherapy during the soaking process.

Figure 5:
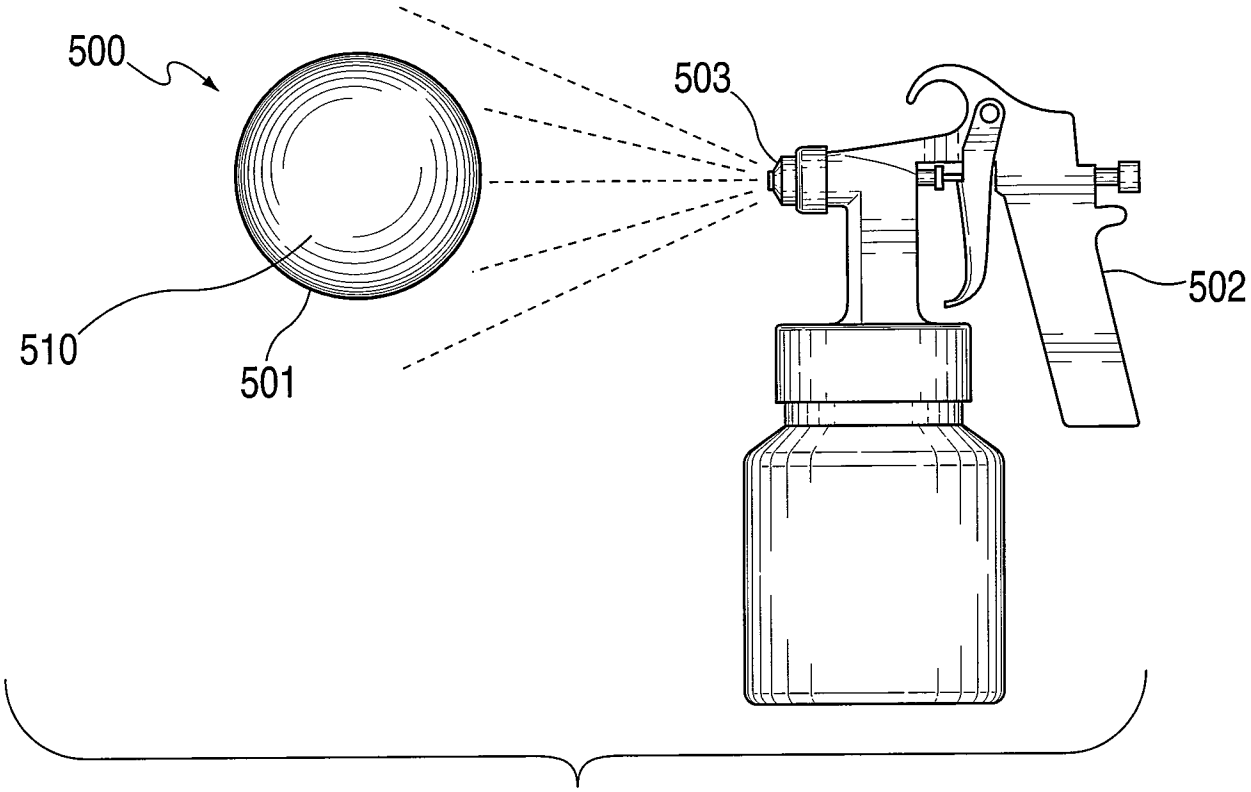
FIG. 5 depicts an exemplary process of introducing the aromatherapy by high-pressure spray gun in accordance with an embodiment of the present invention.

FIG. 5 is a schematic diagram illustrating the process of making a massage device in accordance with an embodiment of the invention. A massage ball 501 is sprayed with aromatherapy using a spray gun 502. The spray gun 502 preferably causes a high-pressure stream of liquid aromatherapy to be deposited on the surface of the massage ball 501. In an embodiment this deposition further leads to the aromatherapy permeating into the interior 510 of the massage ball 501.

Although the spray gun 502 in a preferred embodiment directs a high pressure stream of aromatherapy, a stream of lesser pressure would also suffice, although the length of time required to spray for adequate permeation of the massage ball 501 by the aromatherapy would increase.

The present invention provides stress relief and massage therapy with a spherically shaped ball, provides a device that can be self-administered or second party administered on any part of the body normally massaged in a therapeutic massage format, and provides a device that initiates psychotherapeutic effects via olfactory system through aromatherapy inhalation.

In an embodiment any size massage ball may be employed, although the size generally and preferably ranges from the size of a marble to the size of a softball. The massage ball can be molded from any resilient rubberized material, silicone or any other organic rubber substance. The delicate properties of essential oils make them particularly hard to force into substances like organic rubbers and/or silicone. The preferred temperature, amount of essential oil, and the time spent in airtight containers is different for every aromatherapy essential oil, and may vary due to other environmental conditions.

In a preferred embodiment, the aromatherapy massage balls, or "Tranquility Massage Spheres"™ are multifunctional devices that induce relaxation through aromatherapy and massage. They are smooth surfaced, spherical ball-shaped devices with aromatherapy essential oils infused into them. The individual can manipulate them easily and effectively for self-massage. Effective use is achieved with the device placed between the user and a semi-hard or hard surface. The user initiates relaxation first by inhalation of the scent infused into the sphere and then by using body weight pressure onto the sphere anywhere muscle tension is present. "Tranquility Massage Spheres"™ are totally portable devices that can be self-administered or second person administered to reduce stress and relieve muscle tension. "Tranquility Massage Spheres"™ are able to provide an individual with a practical and user-friendly self-care aromatherapy massage device that can be used anywhere.

A preferred embodiment of the invention uses a massage device having a spherical ball shape that is infused with aromatherapy to stimulate the olfactory senses and relax the body through massage. The device is designed preferably for self-massage, but may also be used by a second individual delivering a massage to a first individual.

Although the invention herein has been described with reference to particular embodiments, it is to be understood that these embodiments are merely illustrative of the principles and applications of the present invention. It will be apparent to those skilled in the art that various modifications and variations can be made in the apparatus and methods of the present invention without departing from the spirit and scope of the invention. Thus, it is intended that the present invention include modifications and variations that are within the scope of the appended claims.

What is claimed:

1. A massage device consisting essentially of at least one porous solid spherical ball saturated with an essential oil which emits qualitative elements for medicinal and relaxation purposes, wherein said at least one porous solid spherical ball has a smooth outer surface and a solid interior portion which consists essentially of at least one compound selected from the group including silicon, rubber and organic rubber; such that said ball is elastic and porous wherein said essential oil permeates and is absorbed within pores of said smooth outer surface and said solid interior portion and is configured to release aromatherapy vapors during manipulation by diffusion and/or evaporation of the essential oil.

2. The device of claim 1, wherein the at least one porous solid spherical ball is configured for rotational manipulation over a body of an user.

3. The device of claim 2, wherein the at least one porous solid spherical ball is further configured for placement in direct contact with the user's skin between the user's body and a flat surface, and wherein the rotational manipulation of the at least one porous solid spherical ball is self-directed by the user.

4. The device according to claim 1 wherein the at least one porous solid spherical ball having a diameter of between one quarter of an inch and six inches.

5. The device according to claim 1, wherein the at least one porous solid spherical ball comprising two or more balls of equal diameter.

6. The device according to claim 1, wherein the at least one porous solid spherical ball comprising two or more balls of varying size.

7. A method of making a massage device comprising the step of introducing an essential oil to a surface of one or more porous solid spherical massage balls having a smooth outer surface and a solid interior portion such that said essential oil permeates and is absorbed within pores of said smooth outer surface and said solid interior portion; wherein said one or more porous solid spherical massage balls consists essentially of at least one compound selected from the group including silicon, rubber and organic rubber having elastic and absorption qualities; such that said one or more porous solid spherical massage balls is configured to release aromatherapy vapors during manipulation by diffusion and/or evaporation of the essential oil.

8. The method according to claim 7, wherein the essential oil is introduced to the surface of the one or more spherical massage balls by spraying the essential oil onto the balls.

9. A method of making a massage device comprising the steps of:

placing a volume of an essential oil into a reservoir portion of a container; and soaking one or more porous solid spherical massage balls in the reservoir portion of the container for a period of time sufficient for the essential oil to saturate the one or more porous solid spherical massage balls;

wherein said one or more porous solid spherical massage balls consists essentially of at least one compound selected from the group including silicon, rubber and organic rubber; such that said essential oil permeates into an interior of said one or more porous solid spherical massage balls.

10. The method according to claim 9, wherein the essential oil emits qualitative elements for medicinal purposes.

11. A method of aromatherapy massage for a user comprising the steps of:

placing one or more porous solid spherical massage balls between the user and a surface, the one or more porous solid spherical massage balls are saturated with an essential oil absorbed within the pores of said one or more porous solid spherical massage balls; and moving by the user relative to the surface, whereby the one or more porous solid spherical massage balls rotates, thereby maintaining contact with the user and the surface;

wherein said one or more porous solid spherical massage balls consists essentially of at least one compound selected from the group including silicon, rubber and organic rubber; such that said one or more porous solid spherical massage balls is elastic and porous and releases aromatherapy vapors during the manipulation by diffusion and/or evaporation of the essential oil.

12. The method according to claim 11, wherein said one or more porous solid spherical massage balls are in direct contact with the user's skin and the movements of the user and the one or more porous solid spherical massage balls deliver a massage to the user.

13. The method according to claim 11, wherein the essential oil emits qualitative elements for medicinal purposes.

14. An aromatherapy massage kit, comprising one or more porous solid spherical massage balls which consist essentially of at least one compound selected from the group including silicon, rubber and organic rubber; such that said one or more porous solid spherical massage balls is elastic and porous;

an aromatherapy essential oil; and a container for immersing the one or more porous solid spherical massage balls into the aromatherapy essential oil such that said aromatherapy essential oil permeates into an interior of said one or more porous solid spherical massage balls.

* * * * *